United States Patent [19]

Arzoumanian et al.

[11] Patent Number: 4,771,689

[45] Date of Patent: Sep. 20, 1988

[54] UNITARY SPRING ARMATURE FOR A DOT MATRIX PRINTER

[75] Inventors: Aram S. Arzoumanian; Calvin E. Moeller, both of Woodland Hills; Kam C. Wong, Canoga Park, all of Calif.

[73] Assignee: Dataproducts Corporation, Woodland Hills, Calif.

[21] Appl. No.: 779,474

[22] Filed: Sep. 25, 1985

[51] Int. Cl.[4] ..... B41J 3/10

[52] U.S. Cl. ..... 101/93.04; 400/121; 400/157.2; 101/93.29; 148/16.5; 335/274

[58] Field of Search ..... 101/93.04, 93.05, 93.29, 101/93.48; 400/121, 124, 157.1, 157.2; 148/16, 16.5; 335/270, 274

[56] References Cited

U.S. PATENT DOCUMENTS 3,408,237 10/1968 Gulliksen et al. ..... 148/16.5
4,165,243 8/1979 Sarnes et al. ..... 148/16.5
4,351,235 9/1982 Bringhurst ..... 101/93.04
4,503,768 3/1985 Whitaker ..... 101/93.04

FOREIGN PATENT DOCUMENTS 57-22073 2/1982 Japan ..... 400/124

*Primary Examiner*—David Wiecking
*Attorney, Agent, or Firm*—Spensley Horn Jubas & Lubitz

[57] ABSTRACT

An elongated unitary spring armature is disclosed for use in dot matrix printers. The spring armature has an elongated triangular shape with attachment means located adjacent to the base and means for securing the impact tip located adjacent to the apex. A spring portion formed of a high carbon steel is located adjacent to the attachment means and an armature portion formed of a low carbon steel separates the spring portion from the apex. Processes for making the spring armature are also disclosed.

20 Claims, 2 Drawing Sheets

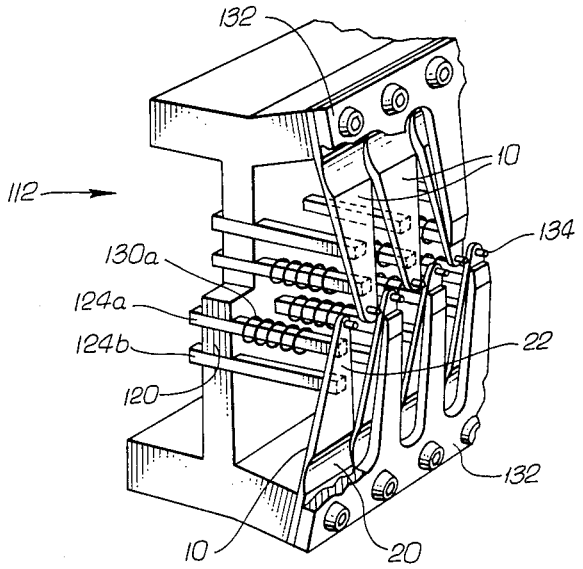
FIG. 1
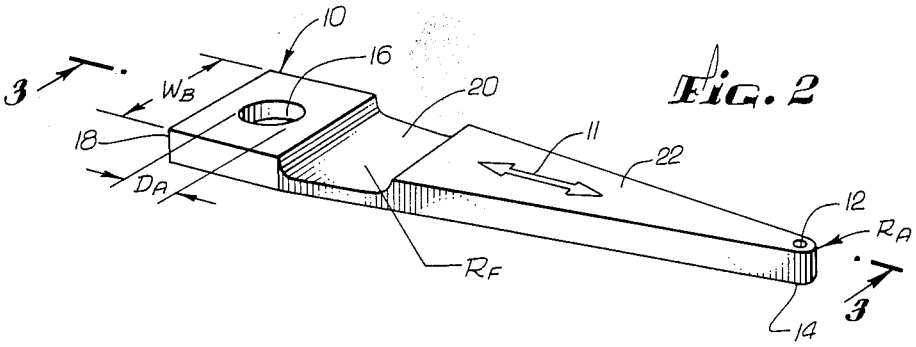
FIG. 2
FIG. 3
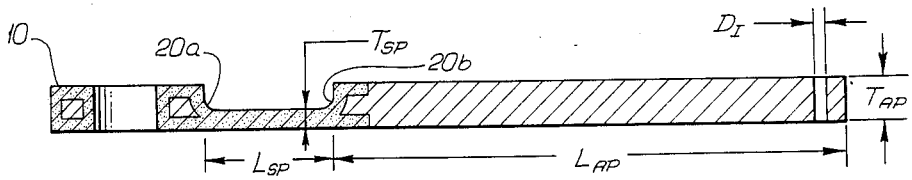

POSITIVE PROCESS

NEGATIVE PROCESS

UNITARY SPRING ARMATURE FOR A DOT MATRIX PRINTER

BACKGROUND OF THE INVENTION

1. Field of Invention.

This invention relates to spring armatures for "stored energy" printing devices and more particularly to spring armatures for dot matrix printers. In such stored energy printing devices, the spring armature is part of a magnetic circuit and is flexed into a retracted position by a permanent magnet attached to an actuator frame. In addition to a permanent magnet as part of each spring armature's actuating mechanism, a coil is also included. The coil generates an electromagnetic field to counteract the field of the permanent magnet, thereby releasing the spring armature to fly towards its impact position. When the spring armature is released, an impact tip at the end of the spring armature causes a dot to appear at the appropriate point on the print medium. As the current in the coil decays towards zero, the electromagnetic field also decays, allowing the spring armature to be retracted by the field from the permanent magnet.

Such dot matrix printers generally have a plurality of such spring armatures and associated actuator assembly attached to the actuator frame to form a print line. The actuator frame usually reciprocates in a direction parallel to the print line. Whenever a spring armature is located opposite to a point where a dot is desired as the actuator frame reciprocates, the appropriate coil is activated and a dot is printed.

2. Description of Prior Art.

In prior art designs of spring armatures, several conflicting design considerations have been taken into account. First, magnetically permeable materials are desired for increasing the flux carrying ability of the spring armature assembly. A highly permeable material used in the armature component of spring armature assemblies is typically a low carbon silicon iron or a low carbon steel; i.e. the carbon content of the steel or iron is less than 0.25% carbon. However, such magnetically permeable materials are generally not suitable for the spring component of the spring armature—for low carbon silicon iron and low carbon steel lack sufficient fatigue endurance to survive the repeated stresses of printing to form a satisfactory spring.

Second, the spring component of the spring armature (i.e. the component experiencing the maximum flexure when the assembly is cocked) should be made from a resilient material with a high fatigue endurance. Typically a high carbon steel or iron is used. However, high carbon steels are not as magnetically permeable as low carbon steels or iron. Thus, the same volume of a high carbon steel cannot carry as much magnetic flux as a low carbon steel.

One method for obtaining the benefits of both high carbon and low carbon steels or iron is to make the spring armature assembly from two separate components—for example, a leaf spring component is formed from a high carbon steel and a separate armature component is made from a magnetically permeable material. The spring component and the armature component are then joined together by welding or other common techniques to form an integral spring armature. Thus the armature is able to carry more magnetic flux, while still being resilient. An example of such a construction is disclosed in U.S. Pat. No. 4,351,235 to Bringhurst. However, a disadvantage of such two-component, integral spring armature assemblies is the joint between the two components is usually substantially weaker than either of the components and may cause reliability problems.

A second area of conflicting design considerations is the trade-off between having a thick cross sectional area to increase the flux carrying ability of the armature versus increasing printing speed. Thickening the cross sectional area of a spring armature will generally increase the mass of the spring armature; with increased mass incorporated in an otherwise identical actuator, the printing speed will be decreased. The decreased printing speed results from a slower acceleration of the spring armature towards the print medium and from a heightened tendency of the armature to rebound when it is retracted to the frame after printing on the media.

Also, thickened cross-sectional area exascerbates the stress in the spring portion. The thicker that spring portion is, the more difficult it is to bend, resulting in greater stress.

Another design choice is whether to place the impact tip near the end of the spring armature or near the center of percussion. Typically, the center of percussion—which is the point where the impact tip should be located to minimize the impulse generated onto the spring armature when the impact tip strikes the print media—is located remote from the unattached end of the spring armature U.S. Pat. No. 3,941,051 to Barrus et al. shows the impact tip being located near the center of percussion. If the impact tip is not located near the center of percussion, the greater impulse may cause the spring armature to rebound away from the frame after it is retracted from the print media. This rebounding slows printing speed Also, the greater impulse received by the spring armature increases the stress experienced by the spring armature reducing the useful lifetime of the spring.

However, in order to make the center of percussion coincide with the impact tip, additional weight has to be added beyond the impact point This greatly increases the effective mass of the spring armature and severly decreases the printing speed of the spring armature. Futhermore, locating the impact tip at the center of percussion of the spring armature limits the distance the impact tip may travel.

In addition, the resonant frequency of the spring portion of the spring armature acts as a maximum limit for the printing speed of the printer. As the printing speed approaches the resonant frequency of spring portion, the printer will cease printing properly.

Thus, it is an object of this invention to provide a unitary spring armature; i.e. the spring armature has no joints.

It is a further object to provide a resilient material in the spring region and a highly permeable material in the armature region while retaining the desired unitary structure.

It is yet a further object of the present invention to provide a spring armature with a minimal mass and with a high flux carrying capability.

Still a further object of the present invention is to provide a design where the impact tip need not be located near the center of percussion and to allow for faster printing.

It is an additional object to maximize the resonant frequency of the spring portion.

SUMMARY OF THE INVENTION

These and other objects are achieved by using an elongated, unitary, triangular-shaped spring armature made from steel or a similar ferrous material The impact tip is located at the apex of the spring armature and an attachment hole for affixing the spring armature to an actuator frame is located adjacent to the base.

Despite the unitary structure, the spring portion of the spring armature consists of a highly resilient material while the armature portion consists of a highly permeable material. The spring portion of the spring armature consists essentially of a resilient material such as a high carbon steel (i.e. greater than 0.75% carbon content) and is substantially thinner than the armature portion, which is made from magnetically permeable material such as low carbon steel (i.e. less than 0.25% carbon content).

To obtain the unitary structure with the different carbon contents in the unitary steel element, one of two processes is used. In one process, a low carbon steel is formed into the desired shape and then the armature portion is masked with a material that is impermeable to carburizing. Then, the exposed spring portion is carburized to the desired level and the mask is removed. An alternative process requires forming the desired shape with a high carbon steel, masking the spring portion and decarburizing the remainder of the unitary structure.

BRIEF DESCRIPTION OF THE DRAWINGS

FIG. 1 is a perspective view of a spring armature according to the present invention as it is incorporated in a dot matrix printer actuator assembly FIG. 2 is a top perspective view of a spring armature made according to the present invention.

FIG. 3 is a cross sectional view of the spring armature of FIG. 2 taken along line 3—3.

DETAILED DESCRIPTION OF THE INVENTION

Figure 4:
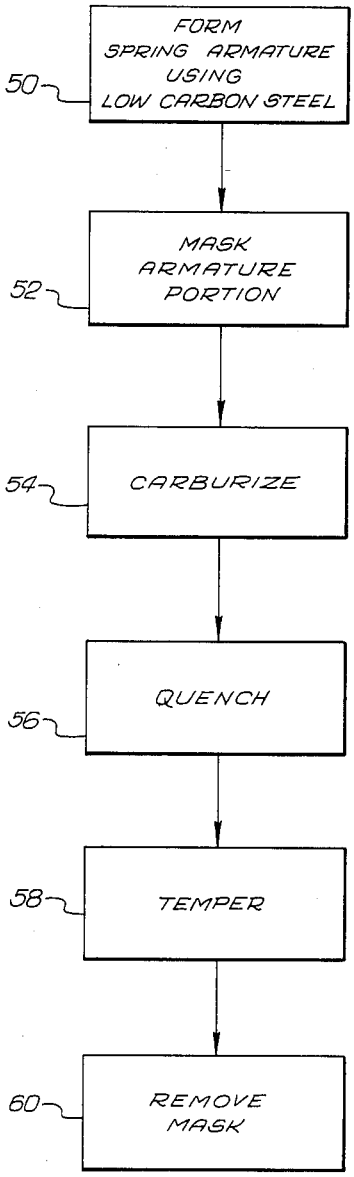
FIG. 4 is a flow chart describing the steps for making the present invention.

The following description is of the best presently contemplated mode of carrying out the invention. The description is made for purpose of illustrating the general principles of the invention and should not be taken in a limiting sense. The scope of the invention is best determined by the appended claims FIG. 1 shows several unitary spring armatures 10 according to the present invention mounted on an actuator bank frame 112 for a dot matrix printer The retraction and actuation of each spring armature 10 is governed by a separate magnetic circuit comprising a permanent magnet 120, pole pieces 124*a* and 124*b* and coil 130. Part of the spring armature 10—that portion positioned between the ends of the pole pieces 124*a* and 124*b*—is also included in the magnetic circuit; however, the remainder of the spring armature 10 is not part of the magnetic circuit With this structure, the spring armature 10 is normally flexed back about a spring portion 20 into a retracted position by a magnetic field furnished by the permanent magnet 120. An armature portion 22 of the spring armature 10 forms part of the magnetic circuit with the magnet 120, the pole pieces 124*a* and 124*b* and the coil 130. To release the spring armature, a current is sent through the coil 130 to produce a magnetic field that counteracts the field generated by the permanent magnet 120. With the counteracting of the magnet's field, the spring armature will spring forward away from its retracted position and towards its relaxed position, causing the impact tip 134 to mark a dot on a print media (not shown). As the current through the coil diminishes towards zero, the magnetic field from the permanent magnet causes the spring armature 10 to return to its retracted position.

As shown in FIGS. 2 and 3, the spring armature 10 is a unitary piece having an elongated, flat triangular shape. An impact tip hole 12 for securing an impact tip 134 (shown in FIG. 1) to the spring armature is located adjacent to the apex 14 of the spring armature 10. An attachment hole 16 for anchoring the spring armature to the actuator frame (112 in FIG. 1) is located adjacent to the base 18. Located between the apex 14 and the base 18 are a spring portion 20 and an armature portion 22, with the armature portion 22 defining the apex 14. Because the spring armature 10 is a unitary structure, it has no joints.

To enhance the ability of the spring portion 20 to withstand repeated flexing during printing, the spring portion is made of a high carbon steel such as AISI 1095. Other conventional high carbon steel or high carbon, low silicon iron materials are also within the scope of the invention.

The spring portion 20 of the spring armature 10 has a substantially smaller cross sectional area taken along line 3—3 in FIG. 2 than the armature portion 22 (i.e. the spring portion 20 is thinner by a factor of more than 2). The reason for the smaller cross sectional area is to reduce the stress in the spring armature when the spring portion is flexed into the retracted position. At each end of the spring portion 20 is a fillet 20*a* or 20*b*, which further reduces the stress in the spring portion.

In contrast, the armature portion 22 is made from a low carbon steel, which is magnetically permeable such as AISI 1010. Unlike the high carbon steel or iron in the spring portion 20, the low carbon steel or iron armature portion is much more prone to fail due to fatigue from repeated flexing than the spring portion 20. The armature portion, however is not substantially bent when the spring armature is flexed into the retracted position. Of course, other conventional low carbon steel and iron materials are also within the scope of the invention.

Also in contrast to the spring portion 20, the armature portion 22 has a greater cross sectional area taken along line 3—3 than the spring portion. That greater cross sectional area improves the magnetic flux carrying ability of the armature portion. However, to minimize the armature portion's mass, it tapers radically to the apex 14.

The dimensions of a preferred embodiment are given in Table 1.

TABLE 1

| DIMENSIONS | | |
|---|---|---|
| REFERENCE SYMBOL | NAME | DIMENSION (inches) |
| $W_B$ | Base Width | 0.250 |
| $L_{SA}$ | Spring Armature Length | 1.020 |
| $L_{AP}$ | Armature Portion Length | 0.640 |
| $L_{SP}$ | Spring Portion Length | 0.180 |
| $R_A$ | Apex Radius | 0.025 |
| $T_{SP}$ | Spring Portion Thickness | 0.025 |
| $T_{AP}$ | Armature Portion Thickness | 0.060 |
| $D_A$ | Attachment Hole Diameter | 0.098 |

TABLE 1-continued

| REFERENCE SYMBOL | DIMENSIONS NAME | DIMENSION (inches) |
|---|---|---|
| $R_F$ | Fillet Radius | 0.050 |
| $D_I$ | Impact Tip Hole Diameter | 0.024 |

Also, because the spring portion 20 is relatively short—approximately one-fifth of the overall length of the spring armature 10—the spring portion acts as a relatively stiff spring with a resonant frequency exceeding the spring armature operating frequency. This stiff spring portion 20 has a resonant frequency sufficiently high in order to cover an operating printing speed of 3 kilohertz.

To obtain a unitary spring armature with the highly resilient steel with high fatigue endurance for the spring portion 20, while having the highly permeable steel for the armature portion 22, two processes may be used. The first process, called the positive process, (FIG. 4) is to form a piece of low carbon steel such as AISI 1010 steel into the desired shape by common metal forming techniques such as extrusion and stamping 50. If extrusion is used, the grain direction of the steel should be parallel to a line perpendicular to the base as shown by the arrow 11 in FIG. 2. Next, the entire armature portion 22 is plated with a mask that is impermeable to carbon 52 while the spring portion 20 is left uncovered. Copper has been found to be an acceptable mask. After plating, the masked spring armature is carburized by exposure to a carbon source such as a stream of a hydrocarbon gas (e.g. methane) at 1550° F. for approximately one hour 54. Because the armature portion 22 is masked, virtually no carbon will diffuse into that portion. However sufficient carbon will diffuse into the naked spring portion and saturate that portion to approximately 0.95% carbon content.

For optimal performance of the spring portion, the carbon content of the spring portion should be at saturation; however, saturation is not necessary. Waiting for saturation provides for better control of the carburizing process and prevents a gradient of carbon concentration in the spring portion 20—with a maximum concentration near the surface and a minimum concentration at the center of the cross-section of the spring portion.

After saturation of the spring portion in the carburizing process, the spring armature should be quenched 56 in an oil bath and then tempered 58 at about 700° F. to obtain a Rockwell C hardness between forty-seven and fifty-one. During tempering, the spring armature should be restrained to maintain its flatness. Upon completion of the tempering step, the copper plating should be stripped by a cyanide solution or a similar reagent so the spring armature has a flat surface 60.

Figure 5:
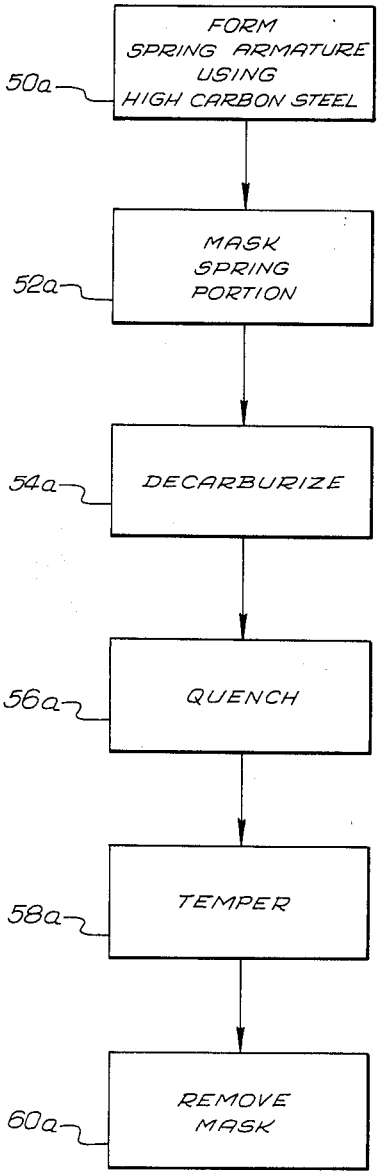
FIG. 5 is a flow chart describing an alternative method for making the present invention.

An alternative process (FIG. 5) to obtain a unitary structure with a highly resilient spring portion 20, while having a magnetically permeable armature portion 22, is to form the spring armature with a high carbon steel such as AISI 1095 steel 50*a* which has a 0.95% carbon content. In this process, which is called the negative process, the spring portion 20 of the formed high carbon element is plated with a mask that is impermeable to carbon 52*a*, however, the armature portion 22 remains naked. After plating, the armature portion is decarburized 54*a*. Steel, for example, may be decarburized by exposure to hydrogen gas at 1550° F. Because the armature portion is significantly thicker than the spring portion (by a factor greater than 2), the decarburizing process lasts substantially longer than the carburizing process 52 in the positive process. The remaining steps—quenching 56*a*, tempering 58*a* and removing the mask 60*a*—are substantially identical to those previously described above.

By use of either of the processes and by use of the shape explained above, an improved unitary spring actuator is obtained. Since one unitary piece of a ferrous substance is used for forming the spring armature, there are no joints. However, despite its unitary structure, the spring armature still has both a highly resilient spring portion made of a high carbon steel and a magnetically permeable portion made from low carbon steel. This unique structure is provided by the masking and carburizing (or decarburizing) process; thus, a high carbon steel with great resiliency can be obtained for the spring portion while a low carbon steel with high magnetic permeability can be obtained for the armature portion. Due to the high magnetic permeability of the armature portion and due to its greater thickness or cross-sectional area, the mass of the armature portion can be reduced while still maintaining a high flux carrying ability.

This structure also allows the impact tip 134 to be mounted remote from the center of percussion, which is near the spring portion 20. Even though the impact tip 134 is remote from the center of percussion, rebounding caused by locating the impact tip 134 away from the center of percussion is not a serious problem. By tapering the armature portion 22, the mass of spring armature portion 22 is reduced and this lessens the impulse that the spring armature would otherwise receive. Furthermore, the thick cross section of the armature portion 22 adds to the rigidity of the armature portion and reduces the rebound when the spring armature is retracted to the frame. And, the spring portion is sufficiently rigid to further reduce the rebound when the spring armature is retracted.

Also, the reduced mass due to tapering allows for higher printing speed. With less mass, the spring armature will not rebound much despite having the impact tip located away from the center of percussion.

In summary, the present invention is directed towards a unitary spring armature having substantially improved performance characteristics over prior art designs. Although specific embodiments of the invention have been described, various modifications and variations within the scope of the invention will be apparent to those skilled in the art.

What is claimed:

1. In a dot matrix printer having a print head which includes a frame and at least one spring armature supported by the frame, the improvement wherein said spring armature comprises:

a jointless member constituted by a single piece of material having an elongated, flat shape with first and second opposed ends, said member comprising:

an attachement portion adjacent to the first end;

a spring portion comprising a resilient material, said spring portion located adjacent to the attachment portion; and an armature portion adjacent to the second end and comprising a magnetically permeable material having a permeability substantially greater than the permeability of the resilient material of the spring portion, and wherein said spring portion has a greater resiliency than said armature portion throughout at least a substantial portion of the thickness of said member.

2. An arrangement as described in claim 1, wherein the armature portion si substantially thicker than the spring portion.

3. An arrangement as described in claim 2, wherein the armature portion further includes a means for securing an impact pin immediately adjacent to the second end.

4. An arrangement as desoribed in claim 3, wherein the unitary spring armature has an elongated, flat triangular shape with the apex of the spring armature defining the second end.

5. An arrangement as described in claim 1, wherein the spring portion consists essentially of a high carbon steel and the armature portion consists essentially of a low carbon steel.

6. An arrangement as described in claim 1, wherein the spring portion comprises a high carbon steel and the armature portion comprises a low carbon steel.

7. In a dot matrix printer having a print head which includes a frame and at least one spring armature supported by the frame, the improvement wherein said spring armature comprises:

an elongated, flat triangular member formed of one piece of steel, with an opposed base and apex, wherein the base is adapted for attachment to the frame and wherein the member comprises armature and spring portions; wherein the armature portion defines the apex, at least part of the armature portion is adapted for forming part of a magnetic circuit and has substantially greater magnetic permeability than the spring portion; and the spring portion is disposed between the base and the armature portion, wherein the spring portion forms a leaf spring and has a greater resiliency than said armature portion throughout at least a substantial portio of the thickness of said member.

8. An arrangement as described in claim 7, wherein the armature portion consists essentially of a low carbon steel and the spring portion consists essentialy of a high carbon steel.

9. An arrangement as described in claim 7, wherein the spring portion comprises a high carbon steel and the armature portion comprises a low carbon steel.

10. In a dot matrix printer having a print head which includes a frame and at least one spring armature supported by the frame, the improvement wherein said spring armature comprises:

a unitary flat elongated triangular shaped member formed of one piece of steel with a base and an apex opposed ot the base, wherein the member includes;

a base portion for attaching the spring armature to the frame;

a tapered, highly magnetically permeable armature portion defining the apex, and having means for securing an impact tip to the armature portion; and a spring portion positioned between the armature portion and the base portion wherein the spring portion is thinner than the armature portion and has a greater resiliency than said armature portion throughout at least a substantial portion of the thickness of said member.

11. An arrangement as described in claim 10, wherein the spring portion is separated from the armature portion by a fillet, whereby stress in the spring armature is reduced.

12. In a dot matrix printer having a print head which includes a frame and at least one spring armature supported by the frame, the improvement wherein said spring armature comprises:

a jointless ferro-magnetic member constituted by a single piece of material and composed of:

(a) a magnetically permeable and relatively rigid armature portion having a low carbon content; and (b) a resilient spring portion of lesser thickness and having a greater carbon content than the armature portion, and wherein said spring portion has a greater resiliency than said armature portion throughout at least a substantial portion of the thickness of said member.

13. An arrangement as described in claim 12, wherein the spring armature has an elongated, flat triangular shape with the armature portion defining an apex and the spring portion being located between the apex and a base.

14. An arrangement as described in claim 13, wherein the spring armature is adapted to be flexed about the spring portion into a cocked position and to be released from that cocked position to cause an impact tip to strike a print medium, whereby the spring armature has a center of percussion, and wherein an impact tip is attached to the spring armature adjacent to the apex, whereby the impact tip is located remote from the center of percussion of the spring armature when the spring armature is released from the cocked position to strike the print medium.

15. In a dot matrix printer having a print head which includes a frame and at least one spring armature supported by the frame, the improvement wherein said spring armature comprises:

a jointless, flat, elongated member constituted by a single piece of material with first and second opposed ends, said member including:

an attachment portion adjacent to one end;

an armature portion adjacent to the second end; and a spring portion between the attachment portion and the armature portion, the spring portion having a resiliency greater than the resiliency of the armature portion throughout at least a substantial portion of the thickness of said member.

16. An arrangement as described in claim 15, wherein the armature portion has a magnetic permeability substantially greater than the magnetic permeability of the spring portion.

17. An arrangement as described in claim 15, wherein the spring portion comprises a high carbon steel and the armature portion comprises a low carbon steel.

18. In a dot matrix printer having a print head which includes a frame and at least one spring armature supported by the frame, the improvement wherein said spring armature comprises:

a jointless, flat, elongated member constituted by a single piece of material with first and second opposed ends, said member including:

an attachment portion adjacent to one end;

an armature portion adjacent to the second end constituting essentially of a highly magnetically permeable material; and a spring portion between the attachment portion and the armature portion, the spring portion consisting essentially of a highly resilient material with the resiliency of the spring portion being greater than the resiliency of the material in the armature portion throughout at least a substantial portion of the thickness of said elongated member.

19. An arrangement as described in claim 18, wherein the armature portion has a magnetic permeability substantially greater than the magnetic permeability of the spring portion.

20. An arrangement as described in claim 19, wherein the highly resilient material is a high carbon steel and the magnetically permeable material is a low carbon steel.

* * * * *